US006929073B2

(12) United States Patent
Thompson

(10) Patent No.: US 6,929,073 B2
(45) Date of Patent: Aug. 16, 2005

(54) FIRE PORT WITH FRANGIBLE CROSSHAIR

(76) Inventor: David M. Thompson, 802 Mantoloking Rd., Bricktown, NJ (US) 08723

( * ) Notice: Subject to any disclaimer, the term of this patent is extended or adjusted under 35 U.S.C. 154(b) by 0 days.

(21) Appl. No.: 10/390,104

(22) Filed: Mar. 17, 2003

(65) Prior Publication Data

US 2004/0182584 A1 Sep. 23, 2004

(51) Int. Cl.[7] ..... A62C 2/00
(52) U.S. Cl. ..... 169/70
(58) Field of Search ..... 169/70

(56) References Cited

U.S. PATENT DOCUMENTS

| | | | | |
|---|---|---|---|---|
| 635,601 | A | * 10/1899 | Schlosser | 169/70 |
| 2,535,311 | A | * 12/1950 | McGann, Jr. | 169/70 |
| 2,732,017 | A | * 1/1956 | Fleming | 169/62 |
| 3,354,508 | A | 11/1967 | Draben | |
| 3,612,345 | A | * 10/1971 | Fike, Jr. | 220/89.2 |
| 3,729,031 | A | 4/1973 | Baldwin | |
| 3,972,373 | A | 8/1976 | Nichols et al. | |
| 4,047,572 | A | * 9/1977 | Stary et al. | 169/62 |
| 4,126,184 | A | * 11/1978 | Hinrichs | 169/56 |
| 5,036,924 | A | * 8/1991 | Carino | 169/70 |
| 5,511,622 | A | * 4/1996 | Thompson | 169/70 |

* cited by examiner

*Primary Examiner*—William C. Doerrler
(74) *Attorney, Agent, or Firm*—Andrew W. Ludy

(57) ABSTRACT

A fire access port is mounted on a flammable material compartment juxtaposed with an access hole. A fire extinguisher nozzle is inserted through the fire port to suppress a fire from outside the compartment The fire port comprises a diaphragm of flexible, resilient material having a predetermined thickness extending between opposite primary and secondary surfaces. First and second transverse grooves extend across the diaphragm primary surface. The grooves have a maximum depth less than the diaphragm thickness, and a floor at the maximum depth, forming first and second frangible webs between each groove floor and the secondary surface. The frangible webs will rupture as the fire extinguisher nozzle is inserted through the diaphragm. An annular ring-like base member extends around the diaphragm. The base member extends from a proximal edge with a predetermined thickness for strength, outward to a distal edge having less thickness. A cylindrical wall extends annularly around the diaphragm for reinforcement. The diaphragm, cylindrical wall, and base member are of one-piece construction.

17 Claims, 4 Drawing Sheets

FIRE PORT WITH FRANGIBLE CROSSHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of fire extinguishing equipment, and more particularly to a fire access port for a flammable material compartment through which fire extinguishing equipment may be inserted, from outside the compartment, to suppress a fire inside the compartment.

Flammable materials are commonly stored or processed in a compartment, locker, container, or shed. Volatiles such as paints, solvents, or chemicals, contained within such a compartment, are subject to accidental fires due to various causes. Typical causes can be spontaneous combustion, lightning strike, electrical short-circuit resulting in overheated wiring, or a carelessly discarded cigarette. Similarly, a vehicle engine, particularly on a boat, is typically housed within a compartment or box. The compartment isolates passengers from the noise, fumes, moving parts, heat, and fire hazard of the engine, and protects the engine from the weather. Despite precautions, engine fires sometimes break out. A fuel leak will spray flammable fuel on a hot engine, resulting in a fire.

Opening the flammable material compartment to fight the fire exposes the operator to heat, flames, and smoke. Opening the flammable material compartment also admits oxygen to feed the fire. A common expedient to fighting such a fire is to install a fire access port on the flammable material compartment. The fire access port typically is a disc of resilient material cut to form a flap or valve. Mounted on the compartment, the fire port is normally in a closed or sealed state. In the event of a fire, a fire extinguisher nozzle is thrust through the fire port, and the fire suppressant chemical is released, without opening the compartment.

Fire access ports are known and have assumed a number of embodiments in the past. Some examples of access ports in the prior art are revealed in the following U.S. Pat. Nos.:

Thompson, U.S. Pat. No. 5,511,622, illustrates a fire port valve having a resilient flap, or stop, attached at the top, which is normally closed. The stop flexes inward, at the attachment, when the nozzle of a fire extinguisher is inserted through the fire port.

Stary, U.S. Pat. No. 4,047,572, discloses a fire access port with two cross slits through a resilient diaphragm. Pressure at the center will immediately permit the flaps of the diaphragm to yield, admitting the nozzle.

Baldwin, U.S. Pat. No. 3,729,031, shows a liquid dispenser and filling apparatus having a resilient sealing plunger sliding within a barrel. The plunger has a self-sealing cross-slit which is pushed open by a fill member in order to fill the barrel with liquid.

Draben, U.S. Pat. No. 3,354,508, illustrates a charging fitting for plastic molding apparatus. A resilient diaphragm with a cross-slit is pushed open by a nozzle to discharge liquid resin therethrough.

In installing a fire port, of the type described above, in a boat or on an outside locker or shed, it is desirable to seal the port against water entering, especially where the compartment is exposed to the weather. Conversely, it is desirable to seal the port against fumes escaping, especially where an engine compartment is inside a cabin. In none of the above-described inventions is the diaphragm positively sealed. In each case, the slit is completely through the diaphragm, so as to facilitate insertion of the nozzle. Such a slit is made with a knife-edge tool, requiring a secondary operation subsequent to molding, with resultant increased cost.

Accordingly, there is a need to provide a fire port that is sealed positively against water entering the flammable material compartment.

There is a further need to provide a fire port of the type described and that is sealed positively against fumes and noise escaping the flammable material compartment.

There is yet a further need to provide a fire port of the type described and that will readily permit easy and rapid insertion of the fire extinguisher nozzle.

There is a still further need to provide a fire port of the type described and that will be ready to install right from molding, with no secondary operation, and hence can be economically manufactured in large numbers of high quality.

There is another need to provide a fire port of the type described and that is easy to use under emergency conditions in the field.

There is yet another need to provide a fire port of the type described and that is rugged in construction so as to provide reliable performance over an extended service life.

BRIEF SUMMARY OF THE INVENTION

In accordance with the present invention, there is provided a fire port for a flammable material compartment. The compartment has an access hole through it. The fire port comprises a diaphragm of flexible, resilient material. The diaphragm has a predetermined thickness extending between opposite primary and secondary surfaces. The diaphragm has a center axis perpendicular to the primary surface. The diaphragm extends from the center axis outward to a diaphragm periphery. The diaphragm has at least one first groove extending across the primary surface. The first groove has a maximum depth less than the diaphragm thickness, and a floor at the maximum depth. The diaphragm has a first frangible web between the first groove floor and the secondary surface. The diaphragm is juxtaposed with the flammable material compartment access hole.

The diaphragm includes a second groove transverse to the first groove. The second groove extends across the primary surface, and has a floor generally at the same depth as the first groove floor. The diaphragm has a second frangible web between the second groove floor and the secondary surface.

An annular ring-like base member extends around the diaphragm. The base member extends from a base proximal edge, adjacent the diaphragm periphery, outward to a base distal edge. The base proximal edge has a predetermined thickness to resist tearing. The base distal edge has a thickness less than the predetermined thickness. Thus, the base distal edge is adapted to present a low profile so as to prevent snagging by clothing and equipment.

A cylindrical wall extends annularly around the diaphragm. The cylindrical wall extends axially from the diaphragm periphery to the base proximal edge. The cylindrical wall has an inner surface and an outer surface. The diaphragm, cylindrical wall, and base member are of one-piece construction, so as to reinforce the diaphragm, as the nozzle is inserted therethrough.

Mounting means are provided for mounting the fire port on the flammable material compartment. Thus, in the event of a fire, a fire extinguisher nozzle will be inserted through the diaphragm, the frangible web will rupture, and the nozzle will enter the flammable material compartment. The fire extinguisher will then be actuated, thereby suppressing the fire.

BRIEF DESCRIPTION OF THE SEVERAL VIEWS OF THE DRAWING

The invention will be more fully understood, while still further objects and advantages will become apparent, in the following detailed description of preferred embodiments thereof illustrated in the accompanying drawing, in which:

FIG. 5 is a front cross-sectional view of the fire port of FIG. 1, taken along lines 5—5 of. FIG. 4;

DETAILED DESCRIPTION OF THE INVENTION

Figure 1:
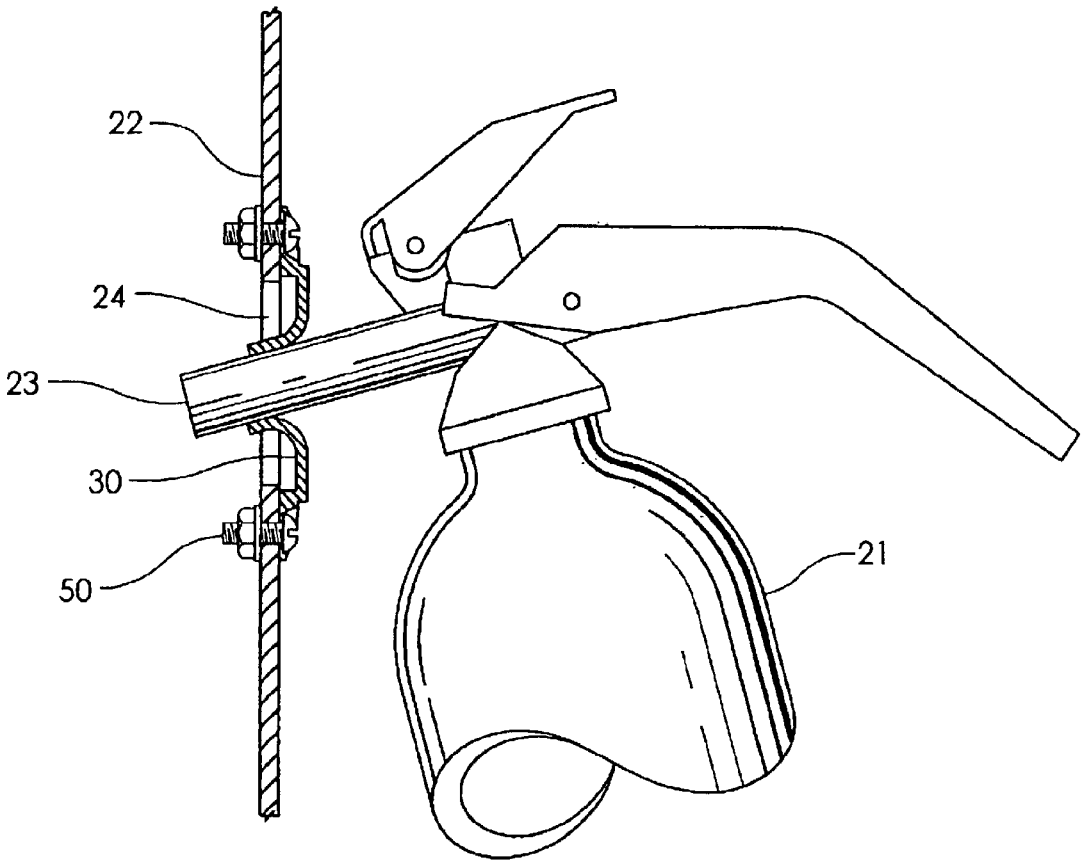
FIG. 1 is a cross-sectional view of a Fire Port With Frangible Crosshair, constructed in accordance with the invention, and mounted in a flammable material compartment, with a fire extinguisher nozzle penetrating the fire port.
Figure 7:
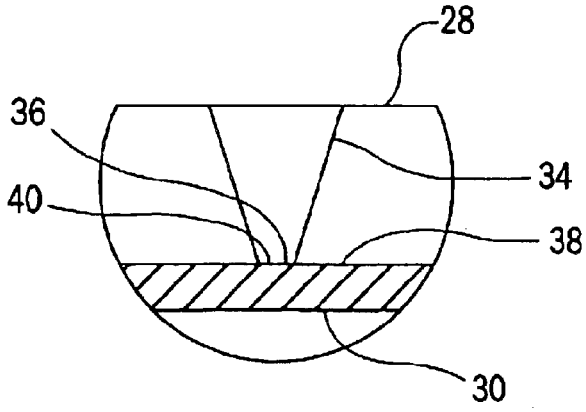
FIG. 7 is an enlarged detail view of FIG. 6, taken at circle 7 of FIG. 6.
Figure 8:
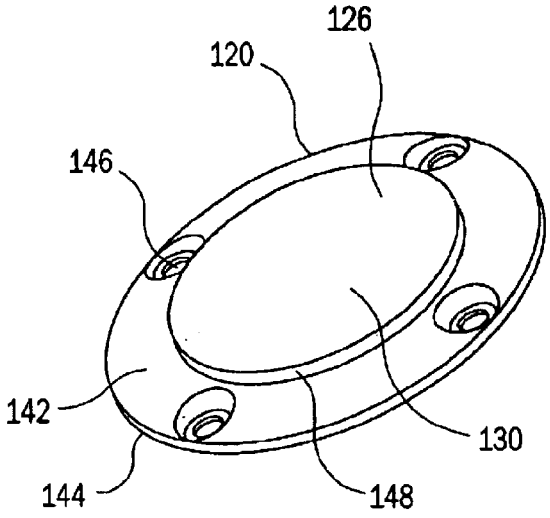
FIG. 8 is a top perspective view of another Fire Port With Frangible Crosshair, constructed in accordance with the invention.
Figure 9:
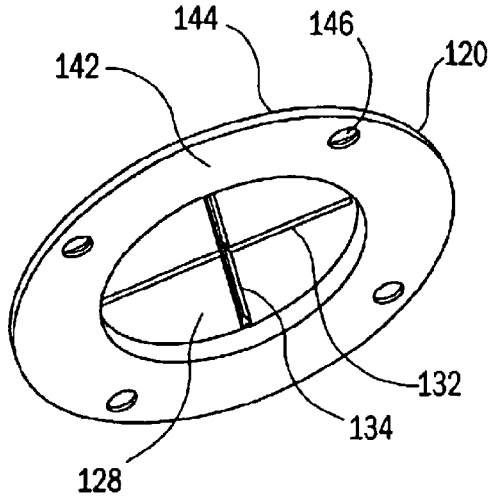
FIG. 9 is a bottom perspective view of the fire port of FIG. 8.
Figure 10:
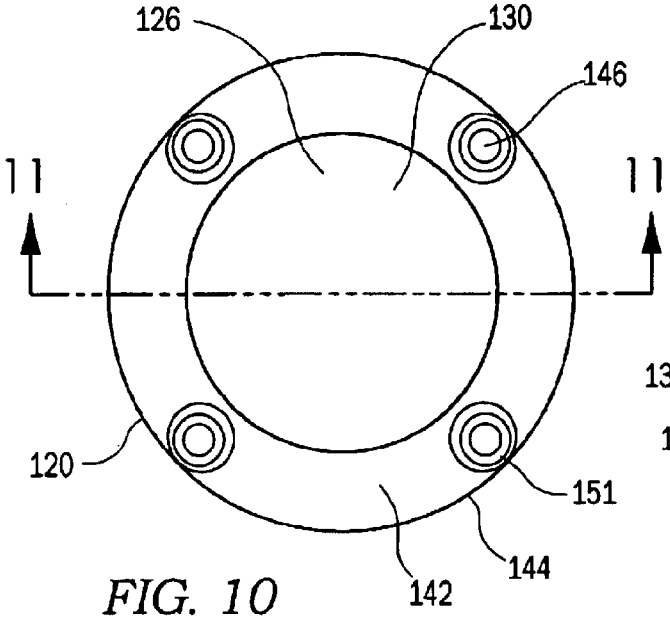
FIG. 10 is a top view of the fire port of FIG. 8.

Referring now to the drawing, and especially to FIGS. 1, 2, 3, 4, 5, 6, and 7 thereof, a fire port constructed in accordance with the invention is shown at 20, and is for use with a fire extinguisher 21, with a nozzle 23, as depicted in FIG. 1. The fire port 20 comprises a diaphragm 26, preferably made of PVC, but any flexible, resilient, frangible material can be used. In the preferred embodiment, the diaphragm 26 is circular in shape. The diaphragm 26 has a predetermined thickness, typically 0.065 inch (1.65 mm), but any convenient thickness will work. The diaphragm 26 extends between opposite primary 28 and secondary 30 surfaces. The diaphragm 26 has a center axis perpendicular to the primary surface 28. The diaphragm 26 extends from the center axis outward to a diaphragm periphery 27. The flammable material compartment 22 has an access hole 24 therethrough. The diaphragm 26 is mounted on the compartment 22, and is juxtaposed with the compartment access hole 24. The primary surface 28 faces outward on the compartment 22. The diaphragm 26 has first 32 and second 34 grooves extending across the primary surface 28. The second groove 34 is transverse to the first groove 32. The first 32 and second 34 grooves have a maximum depth less than the diaphragm thickness. The first 32 and second 34 grooves each have a floor 36 at the maximum depth, as shown in FIG. 7. The diaphragm 26 has a first frangible web 38 between the first groove floor 36 and the secondary surface 30. The diaphragm 26 has a second frangible web 40 between the second groove floor 36 and the secondary surface 30. The first 32 and second 34 grooves taper outward in width from the floor 36 to the primary surface 28, forming a generally V-shaped cross-section, as shown in FIG. 7, to provide draft for molding. The webs 38 and 40 are typically about 0.012 inch (0.3 mm), but this will vary with the thickness of the diaphragm and the material used.

An annular ring-like base member 42 extends around the diaphragm 26. The base member 42 extends from a base proximal edge 43, adjacent the diaphragm periphery 27, outward to a base distal edge 44. The base proximal edge 43 has a predetermined thickness to resist tearing. The base distal edge 44 has a thickness less than the predetermined thickness. Thus, the base distal edge 44 is adapted to present a low profile so as to prevent snagging by clothing and; equipment.

A cylindrical wall 48 extends annularly around the diaphragm 26. The cylindrical wall 48 extends axially from the diaphragm periphery 27 to the base proximal edge 43. The cylindrical wall 48 has an inner surface 47 and an outer surface 49. The diaphragm 26, cylindrical wall 48, and base member 42 are of one-piece construction, so as to reinforce the diaphragm 26, as the nozzle 23 is inserted therethrough.

Mounting means is provided for mounting the fire port 20 on the flammable material compartment 22. Specifically, fire port 20 includes a plurality of mounting holes 46 therethrough, arrayed around the base member 42. A nut and bolt 50 typically extends through each mounting hole 46 and through the compartment 22, although any type of fastener can be used. The mounting holes have counterbores 51 to ensure that the mounting holes 46 are adapted for mounting the fire port 20 on the flammable material compartment 22 with fasteners only. No bolting plate or flange is necessary.

Thus, in the event of a fire, the fire extinguisher nozzle 23 will be inserted through the diaphragm 26, the frangible webs 38 and 40 will rupture, the nozzle 23 will enter the flammable material compartment 22, and the fire extinguisher 21 will be actuated, thereby suppressing the fire.

Figure 12:
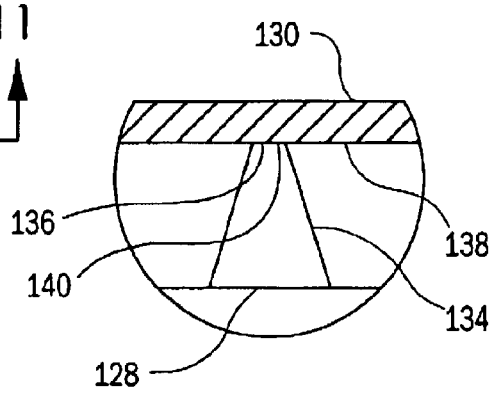
FIG. 12 is an enlarged detail view of FIG. 11, taken at circle 12 of FIG. 11.
Figure 11:
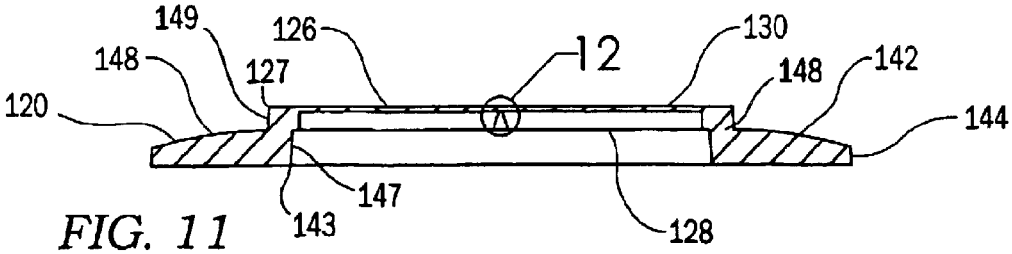
FIG. 11 is a front cross-sectional view of the fire port of FIG. 10, taken along lines 11—11 of FIG. 10.
Figure 13:
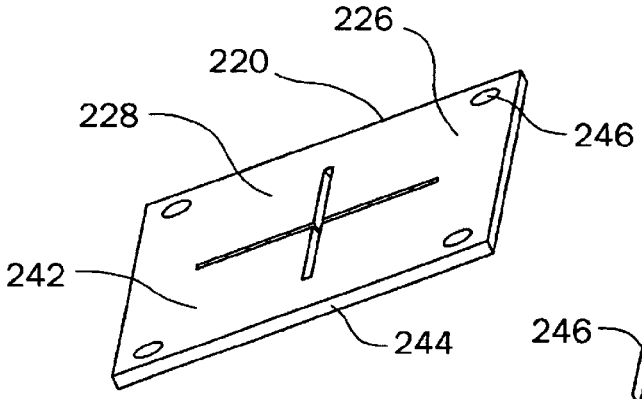
FIG. 13 is a top perspective view of yet another Fire Port With Frangible Crosshair, constructed in accordance with the invention.
Figure 14:
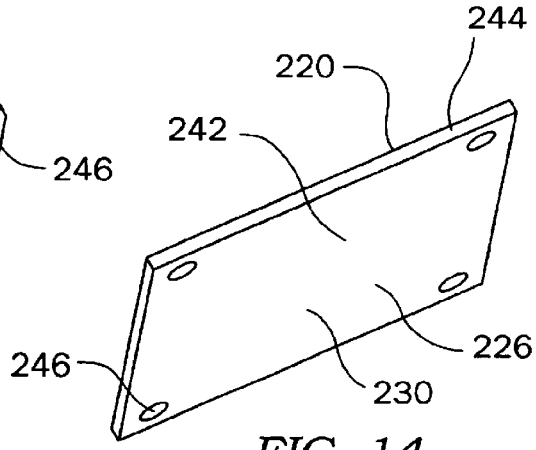
FIG. 14 is a bottom perspective view of the fire port of FIG. 13.
Figure 15:
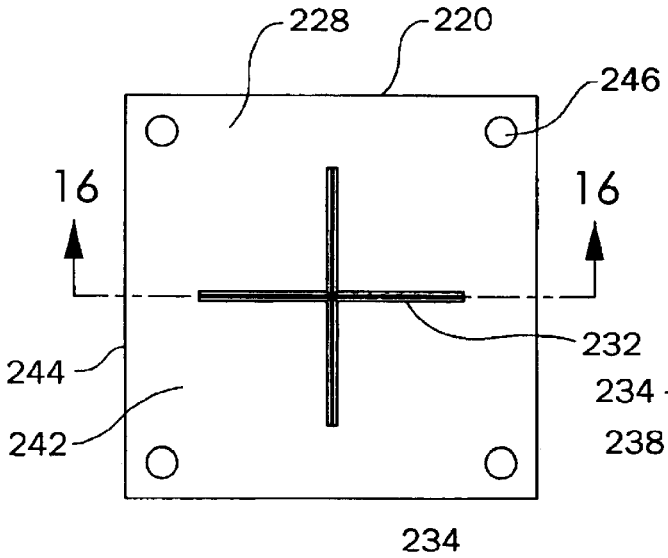
FIG. 15 is a top view of the fire port of FIG. 13.

Turning now to FIGS, 8, 9, 10, 11, and 12, another fire port constructed in accordance with the invention is shown at 120. Fire port 120 is similar to the invention of FIG. 2, in that fire port 120 comprises a diaphragm 126, which is circular in shape. The diaphragm 126 has a predetermined thickness, and extends between opposite primary 128 and secondary 130 surfaces. The diaphragm 126 has a center axis perpendicular to the primary surface 128. The diaphragm 126 extends from the center axis outward to a diaphragm periphery 127. The diaphragm 126 has first 132 and second 134 grooves extending across the primary surface 128. The second groove 134 is transverse to the first groove 132. The first 132 and second 134 grooves have a maximum depth less than the diaphragm thickness. The first 132 and second 134 grooves each have a floor 136 at the maximum depth, as shown in FIG. 12. The diaphragm 126 has a first frangible web 138 between the first groove floor 136 and the secondary surface 130. The diaphragm 126 has a second frangible web 140 between the second groove floor 136 and the secondary surface 130. The first 132 and second 134 grooves taper outward in width from the floor 136 to the primary surface 128, forming a generally V-shaped cross-section, as shown in FIG. 12.

An annular ring-like base member 142 extends around the diaphragm 126. The base member 142 extends from a base proximal edge 143, adjacent the diaphragm periphery 127, outward to a base distal edge 144. The base proximal edge 143 has a predetermined thickness to resist tearing. The base distal edge 144 has a thickness less than the predetermined thickness. Thus, the base distal edge 144 is adapted to present a low profile so as to prevent snagging by clothing and equipment.

A cylindrical wall 148 extends annularly around the diaphragm 126. The cylindrical wall 148 extends axially from the diaphragm periphery 127 to the base proximal edge 143. The cylindrical wall 148 has an inner surface 147 and an outer surface 149. The diaphragm 126, cylindrical wall 148, and base member 142 are of one-piece construction, so as to reinforce the diaphragm 126, as the nozzle 23 is inserted therethrough.

Fire port 120 includes a plurality of mounting holes 146 therethrough, arrayed around the base member 142. The mounting holes 146 have counterbores 151.

Figure 2:
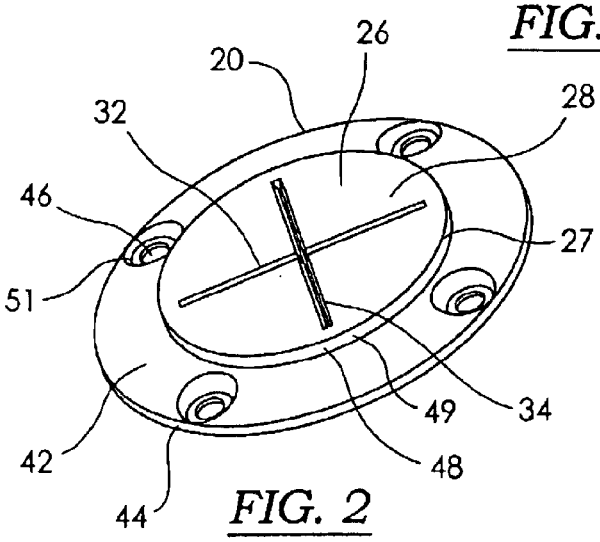
FIG. 2 is a top perspective view of the fire port of FIG. 1.
Figure 3:
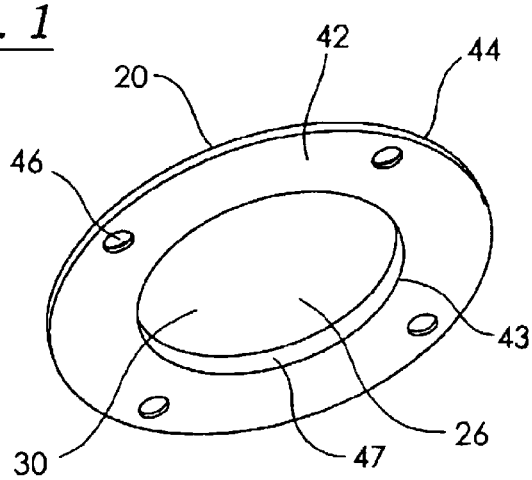
FIG. 3 is a bottom perspective view of the fire port of FIG. 1.
Figure 4:
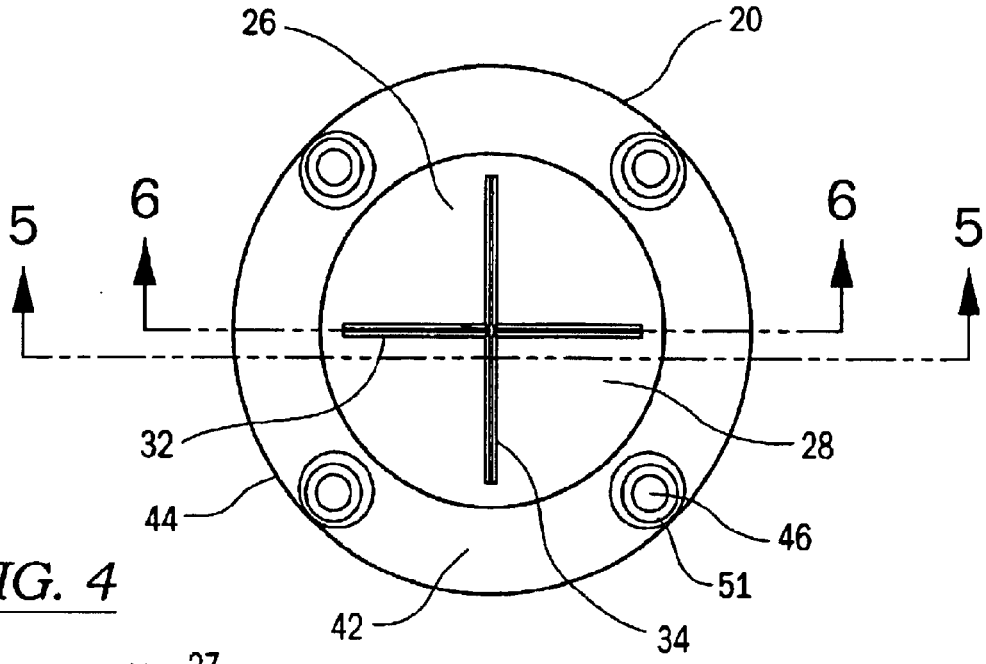
FIG. 4 is a top view of the fire port of FIG. 1.
Figure 5:
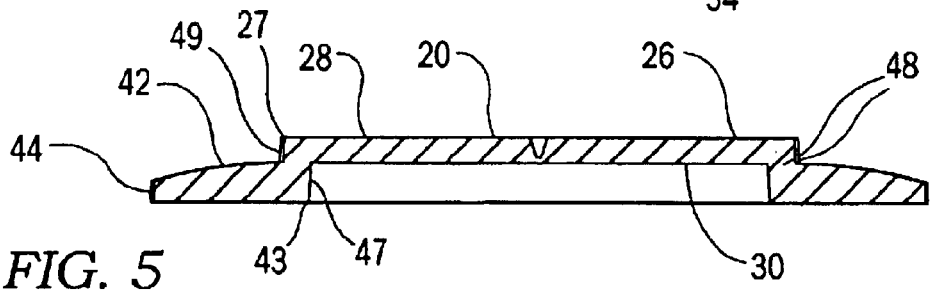
Figure 6:
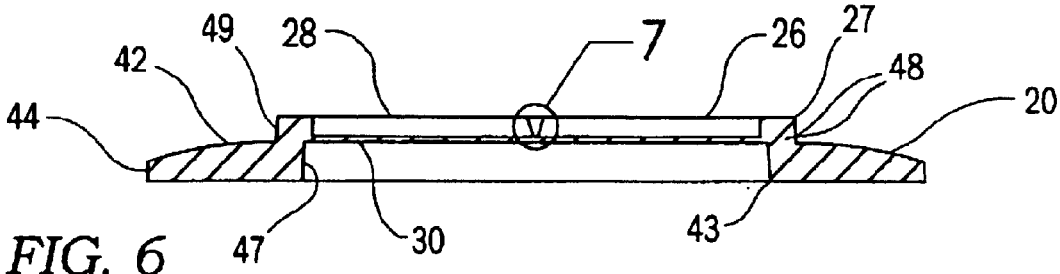
FIG. 6 is a front cross-sectional view of the fire port of FIG. 1, taken along lines 6—6 of FIG. 4.

Fire port 120 differs from the invention of FIG. 2, in that the secondary surface 130 faces outward on the flammable material compartment (not shown). The primary surface 128, having the grooves 132 and 134, faces inward on the compartment.

Figure 17:
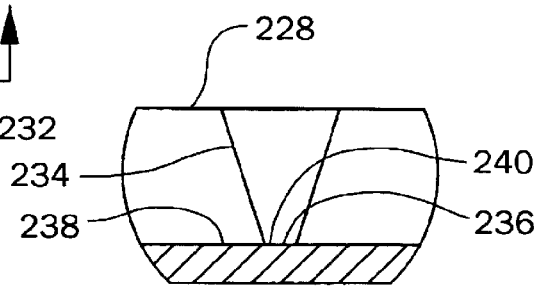
FIG. 17 is an enlarged detail view of FIG. 16, taken at circle 17 of FIG. 16.
Figure 16:
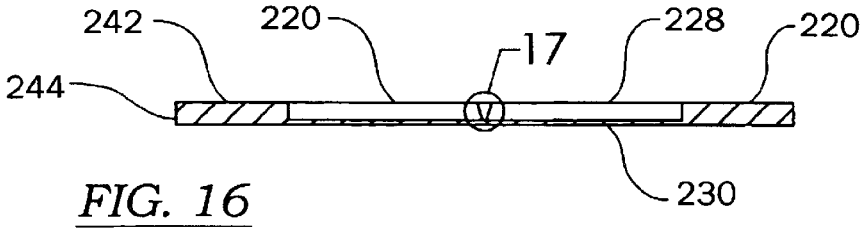
FIG. 16 is a front cross-sectional view of the fire port of FIG. 13, taken along lines 16—16 of FIG. 15.

Referring now to FIGS. 13, 14, 15, 16, and .17, another embodiment of the invention is shown at 220. Fire port 220 is similar to the invention of FIG.: 2, in that fire port 220 comprises a diaphragm 226. The diaphragm 226 has a predetermined thickness, and extends between opposite primary 228 and secondary 230 surfaces. The diaphragm 226 has first 232 and second 234 grooves extending across the primary surface 228. The second groove 234 is transverse to the first groove 232. The first 232 and second 234 grooves have a maximum depth less than the diaphragm thickness. The first 232 and second 234 grooves each have a floor 236 at the maximum depth, as shown in FIG. 17. The diaphragm 226 has a first frangible web 238 between the first groove floor 236 and the secondary surface 230. The diaphragm 226 has a second frangible web 240 between the second groove floor 236 and the secondary surface 230. The first 232 and second 234 grooves taper outward in width from the floor 236 to the primary surface 228, forming a generally V-shaped cross-section, as shown in FIG. 17. Fire port 220 includes a plurality of mounting holes 246 therethrough.

Fire port 220 differs from the invention of FIG. 2, in that the diaphragm 226 extends outward through a base member 242 to a rectangular periphery 244. The diaphragm 226 is thus unitary with the base member 242. There is no cylindrical wall. The primary surface 228, having the grooves 232 and 234, can face either inward or outward on the flammable material compartment (not shown).

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

The embodiments of the invention in which an exclusive property or privilege is claimed are defined as follows:

1. A fire port for a flammable material compartment, the compartment having an access hole therethrough, the fire port comprising:

a diaphragm, the diaphragm having a predetermined thickness extending between opposite primary and secondary surfaces, the diaphragm having a center axis perpendicular to the primary surface, the diaphragm extending from the center axis outward to a diaphragm periphery, the diaphragm having at least one first groove extending across the primary surface, the first groove having a maximum depth less than the diaphragm thickness, the first groove having a floor at the maximum depth, the diaphragm having a first frangible web between the first groove floor and the secondary surface, the diaphragm being juxtaposed with the compartment access hole;

a base member extending annularly around the diaphragm, the base member extending from a base proximal edge adjacent the diaphragm periphery, outward to a base distal edge, the base proximal edge having a predetermined thickness to resist tearing, the base distal edge having a thickness less than the predetermined thickness, the base distal edge being adapted to present a low profile so as to prevent snagging by clothing and equipment;

a cylindrical wall extending axially from the diaphragm periphery to the base proximal edge, the cylindrical wall extending annularly around the diaphragm, the cylindrical wall having an inner surface and an outer surface, the diaphragm, cylindrical wall, and base member being of one-piece construction, so as to reinforce the diaphragm as the nozzle is inserted therethrough; and mounting means for mounting the fire port on the compartment, so that in the event of a fire, a fire extinguisher nozzle will be inserted through the diaphragm, the frangible web will rupture, the nozzle will enter the compartment, and the fire extinguisher will be actuated, thereby suppressing the fire.

2. The fire port of claim 1, wherein the diaphragm further comprises:

a second groove transverse to the first groove in the diaphragm, the second groove extending across the primary surface, the second groove having a floor generally at the same depth as the first groove floor; and a second frangible web between the second groove floor and the secondary surface.

3. The fire port of claim 2, wherein the mounting means further comprises a plurality of mounting holes through the base member, the mounting holes having counterbores, the mounting holes being adapted for mounting the fire port on the flammable material compartment with fasteners only.

4. The fire port of claim 3, wherein the first and second grooves taper outward in width from the floor to the primary surface, forming a generally V-shaped cross-section, to provide draft for molding.

5. The fire port of claim 3, wherein the primary surface faces outward on the flammable material compartment.

6. The fire port of claim 3, wherein the secondary surface faces outward on the flammable material compartment.

7. A fire port for a flammable material compartment, the compartment having an access hole therethrough, the fire port comprising:

a diaphragm, the diaphragm having a predetermined thickness extending between opposite primary and secondary surfaces, the diaphragm having a center axis perpendicular to the primary surface, the diaphragm extending from the center axis outward to a diaphragm periphery, the diaphragm having at least one first groove extending across the primary surface, the first groove having a maximum depth less than the diaphragm thickness, the first groove having a floor at the maximum depth, the diaphragm having a first frangible web between the first groove floor and the secondary surface, the diaphragm being juxtaposed with the compartment access hole;

a base member extending annularly around the diaphragm, the base member extending from a base proximal edge adjacent the diaphragm periphery, outward to a base distal edge;

a cylindrical wall extending axially from the diaphragm periphery to the base proximal edge, the cylindrical wall extending annularly around the diaphragm, the cylindrical wall having an inner surface and an outer surface, the diaphragm, cylindrical wall, and base member being of one-piece construction, so as to reinforce the diaphragm as the nozzle is inserted therethrough; and mounting means for mounting the fire port on the compartment, so that in the event of a fire, a fire extinguisher nozzle will be inserted through the diaphragm, the frangible web will rupture, the nozzle will enter the compartment, and the fire extinguisher will be actuated, thereby suppressing the fire.

8. The fire port of claim 7, wherein the base proximal edge has a predetermined thickness to resist tearing, the base distal edge has a thickness less than the predetermined thickness, and the base distal edge is adapted to present a low profile so as to prevent snagging by clothing and equipment.

9. The fire port of claim 8, wherein the diaphragm further comprises:

a second groove transverse to the first groove in the diaphragm, the second groove extending across the primary surface, the second groove having a floor generally at the same depth as the fist groove floor; and a second frangible web between the second groove floor and the secondary surface.

10. The fire port of claim 9, wherein the mounting means further comprises a plurality of mounting holes through the base member, the mounting holes having counterbores, the mounting holes being adapted for mounting the fire port on the flammable material compartment with fasteners only.

11. The fire port of claim 10, wherein the first and second grooves taper outward in width from the floor to the primary surface, forming a generally V-shaped cross-section, to provide draft for molding.

12. The fire port of claim 10, wherein the primary surface faces outward on the flammable material compartment.

13. The fire port of claim 10, wherein the secondary surface faces outward on the flammable material compartment.

14. A fire port for a flammable material compartment, the compartment having an access hole therethrough, the fire port comprising:

a diaphragm of flexible material, the diaphragm having a predetermined thickness, the diaphragm extending between opposite primary and secondary surfaces, the diaphragm having a center axis perpendicular to the primary surface, the diaphragm extending from the center axis outward to a diaphragm periphery, the diaphragm having first and second grooves extending across the primary surface, the second groove being transverse to the first groove, the first and second grooves having a maximum depth less than the diaphragm thickness, the first and second grooves each having a floor at the maximum depth, the diaphragm having a first frangible web between the first groove floor and the secondary surface, the diaphragm having a second frangible web between the second groove floor and the secondary surface, the diaphragm being juxtaposed with the compartment access hole;

a base member extending annularly around the diaphragm, the base member extending from a base proximal edge adjacent the diaphragm periphery, outward to a base distal edge, the base proximal edge having a predetermined thickness to resist tearing, the base distal edge having a thickness less than the predetermined thickness, the base distal edge being adapted to present a low profile so as to prevent snagging by clothing and equipment, the base member having a plurality of mounting holes there through, the mounting holes having counterbores, the mounting holes being adapted for mounting the fire port on the flammable material compartment with fasteners only; and a cylindrical wall extending axially from the diaphragm periphery to the base proximal edge, the cylindrical wall extending annularly around the diaphragm, the cylindrical wall having an inner surface and an outer surface, the diaphragm, cylindrical wall, and base member being of one-piece construction, so as to reinforce the diaphragm as the nozzle is inserted therethrough, so that in the event of a fire, a fire extinguisher nozzle will be inserted through the diaphragm, the frangible webs will rupture, the nozzle will enter the compartment, and the fire extinguisher will be actuated, thereby suppressing the fire.

15. The fire port of claim 14, wherein the first and second grooves taper outward in width from the floor to the primary surface, forming a generally V-shaped cross-section, to provide draft for molding.

16. The fire port of claim 14, wherein the primary surface faces outward on the flammable material compartment.

17. The fire port of claim 14, wherein the secondary surface faces outward on the flammable material compartment.

* * * * *